US006598739B1

(12) United States Patent
Collura

(10) Patent No.: US 6,598,739 B1
(45) Date of Patent: Jul. 29, 2003

(54) BOTTLE CARRIER

(75) Inventor: Peter Collura, Boynton Beach, FL (US)

(73) Assignee: Peter C Collura, Palm City, FL (US)

( * ) Notice: Subject to any disclaimer, the term of this patent is extended or adjusted under 35 U.S.C. 154(b) by 61 days.

(21) Appl. No.: 09/968,871

(22) Filed: Oct. 3, 2001

Related U.S. Application Data

(60) Provisional application No. 60/237,191, filed on Oct. 3, 2000.

(51) Int. Cl.[7] ..... B65D 75/00

(52) U.S. Cl. ..... 206/185; 206/186; 206/193

(58) Field of Search ..... 206/162, 167, 206/170, 175, 180, 192, 193, 196, 185, 186, 427

(56) References Cited

U.S. PATENT DOCUMENTS 2,974,827 A * 3/1961 Levkoff ..... 206/186
3,411,663 A * 11/1968 Moore et al. ..... 206/185
4,782,944 A * 11/1988 Engdahl, Jr. ..... 206/186
6,168,013 B1 * 1/2001 Gomes ..... 206/193

* cited by examiner

*Primary Examiner*—Luan K. Bui

(57) ABSTRACT

A bottle carrier is foldable from a single blank, and is relatively strong, inexpensive to manufacture, aesthetic in appearance, and easy to assemble. The carrier has several advantages: it provides a reduction in paper board costs, improves manufacturing costs, retains the "basket" features demanded by the marketing needs of the beverage industry, and improves packaging line production at the beverage manufacturing location. The carrier is made by folding operations and separation along score lines. The carrier has internal longitudinal and transverse product separation, handle reinforcement, and bottom closure flaps. The carrier blank is formed as a die cut component, which is then assembled by folding and adhesive applied to designated locations. The finished carrier is then collapsed for transit, and the bottom flap can be secured at the manufacturing location. In a second embodiment, the bottom is already secured, and folds away from the partition portions when collapsed for transit. The collapsed carrier is then delivered to the beverage or glass manufacturing location. The carrier is then erected, and thus is ready for filling with product. The carrier can be filled either on or off a bottling line.

20 Claims, 6 Drawing Sheets

BOTTLE CARRIER

This application claims the benefit of provisional application 60/237,191 filed Oct. 3, 2000.

FIELD OF THE INVENTION

The present invention relates to foldable blanks for forming bottle carriers, and to a process and method for assembling a bottle carrier from foldable blanks.

BACKGROUND OF THE INVENTION

Packages are known in the prior art for carrying bottles or cans. Such carriers can be formed of plastic, cardboard, or other materials. However, it is a problem in the art to provide a bottle carrier which is relatively strong, inexpensive to manufacture, aesthetic in appearance, and easy to assemble.

U.S. Pat. No. 4,327,829 to Hughes teaches a display carton and blank therefor. The assembled carton has openable ends.

U.S. Pat. No. 4,509,640 to Joyce teaches a carton with separators, a blank, and an apparatus for erecting a carton from the blank. A relatively complex blank and folding operation are shown.

U.S. Pat. No. 4,588,077 to Champlin et al. teaches a carrier handle. The carrier handle is formed by a folded blank having two holes, the two holes being in overlying relationship in the assembled carrier to form a handle portion.

U.S. Pat. No. 4,406,365 to Kulig discloses a basket type bottle carrier. The bottle carrier has an integral handle portion formed from holes in the blank used to form the carrier.

U.S. Pat. No. 5,709,298 to Harris teaches a basket-style carrier with non-collapsing end panels. The carrier is formed from a single blank, the blank having holes forming the handle portion.

U.S. Pat. No. 4,770,294 to Graser teaches a two-piece beverage carrier. The carrier is formed from two foldable blanks.

U.S. Pat. No. 4,362,240 to Elward teaches an article carrier carton. The carton is formed from a blank and can carry six bottles.

U.S. Pat. No. 4,147,290 to Stout teaches an article carrier handle structure. The handle is formed from a blank having interrupted cut lines.

U.S. Pat. No. 2,382,844 to Arneson is directed to a bottle carrier. The carrier is formed from a blank, and includes hole portions used to form a handle.

U.S. Pat. No. 2,239,564 to Lyons, Jr., is directed to a folding bottle carrying carton. The carton is formed from a blank, and has a handle.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides bottle carrier which is relatively strong, inexpensive to manufacture, aesthetic in appearance, and easy to assemble.

The beverage industry markets products in a printed paper board carrier holding multiple units of glass and plastic containers. This package is commonly referred to as a basket. The "basket" provides individual product separation minimizing product damage during the shipping and distribution cycle. Current "baskets" in use provide attractive graphics which are multi-color printed, have a substantial carry handle, and have an open top which facilitates easy access, removal, and replacement of the product.

The basic "basket" as now commonly used has existed for several decades. Over the years there have been minor revisions to this basic "basket" for the sake of cost reduction. The "basket" has survived the marketing needs of the beverage industry by providing a consumer friendly package to the end user.

The paper board used on current "baskets" is a special custom formulated sheet. This special sheet is used for the total one-piece "basket". The sheet provides excellent white printing surface, superior tear strength, improved stiffness, and surfaces and finish resistant to moisture absorption. The beverage and packaging industries are continually seeking a more cost effective package while retaining the consumer friendly features of the present "basket".

The carrier according to the present invention has:several advantages. It provides a reduction in paper board costs. It improves manufacturing costs of the present "basket". It retains the "basket" features demanded by the marketing needs of the beverage industry. And, it improves packaging line production at the beverage manufacturing location.

More specifically, the carrier according to the present invention is made by folding a single blank made from paper board. This single blank, when completely folded and glued as necessary, forms both a handle portion and a plurality of compartments for holding beverage containers. This blank includes elements which will become a shell portion which provides all "basket" printed panels and a handle visible to the consumer on the display shelf. The blank can be made from a white coated paper board or other material combination providing an adequate printing surface.

The blank, in addition to elements which will form the shell portion, also includes elements forming the internal longitudinal and transverse product separation, handle reinforcement, and bottom closure flaps. This portion includes what is called in the trade a partition assembly. The partition assembly does not require printing, since it is not readily visible to the consumer when filled with articles to be carried.

The single blank, which forms both the shell portion and the partition assembly, is preferably formed as a die cut sheet, which is then accurately folded and joined by adhesive applied to designated locations. The thus-folded and secured assembly is then further folded and glued to form a collapsed "basket". The collapsed "basket" is then delivered to the beverage or glass manufacturing location. The "basket" is then erected, and—in a first embodiment—bottom flaps are folded and adhesively secured, and thus is ready for filling with product. The "basket" can be filled either on or off a bottling line. In a second embodiment, the bottom flaps are pre-glued and are part of the fold assembly provided to the beverage or glass manufacturing location.

Other objects and advantages of the present invention will be more readily apparent from the following detailed description when read in conjunction with the accompanying drawings.

DETAILED DESCRIPTION OF THE INVENTION

Figure 1:
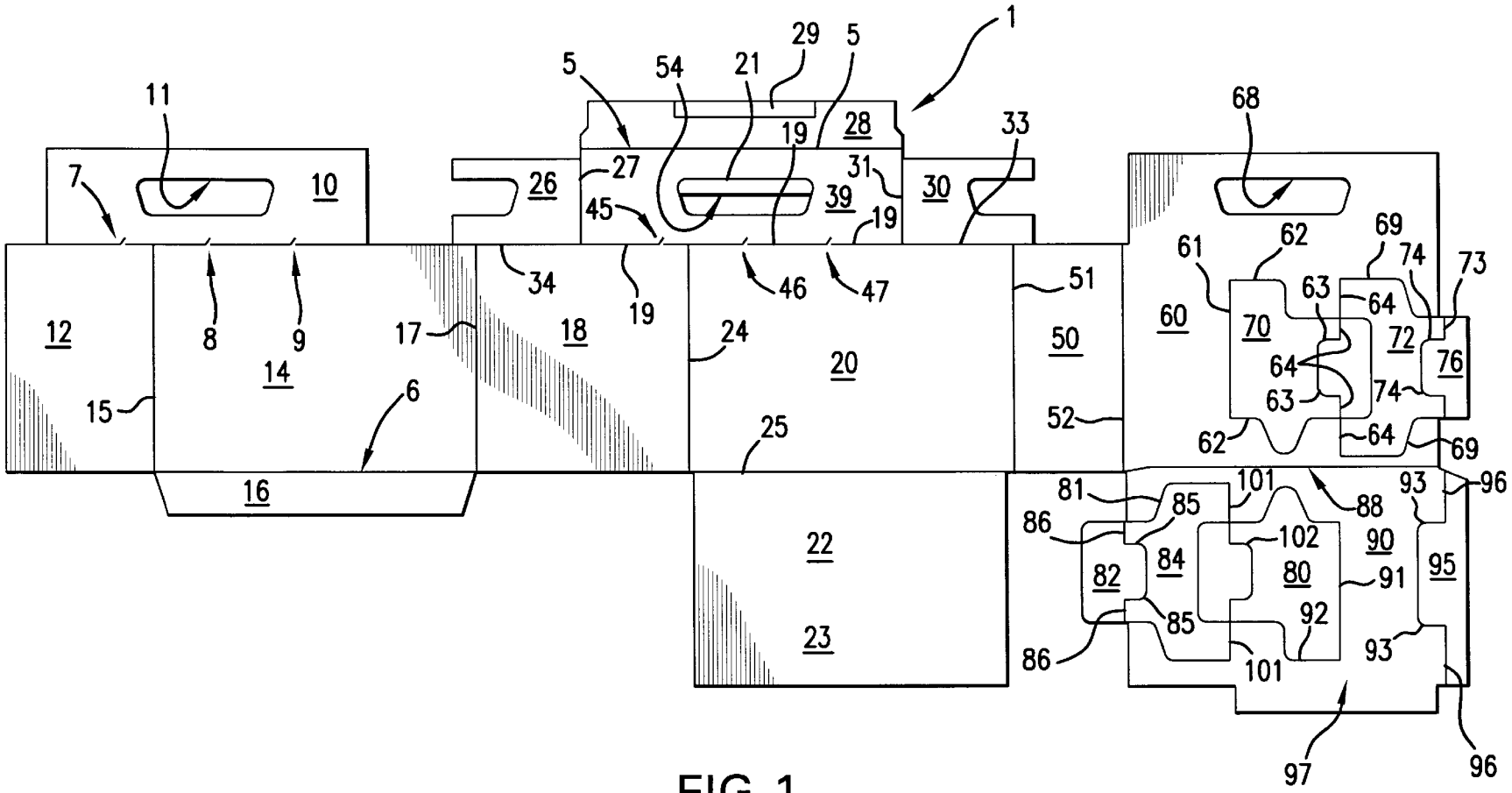
FIG. 1 is an elevational view of a blank for a partition assembly used to form a carrier, according to one embodiment of the present invention.
Figure 2:
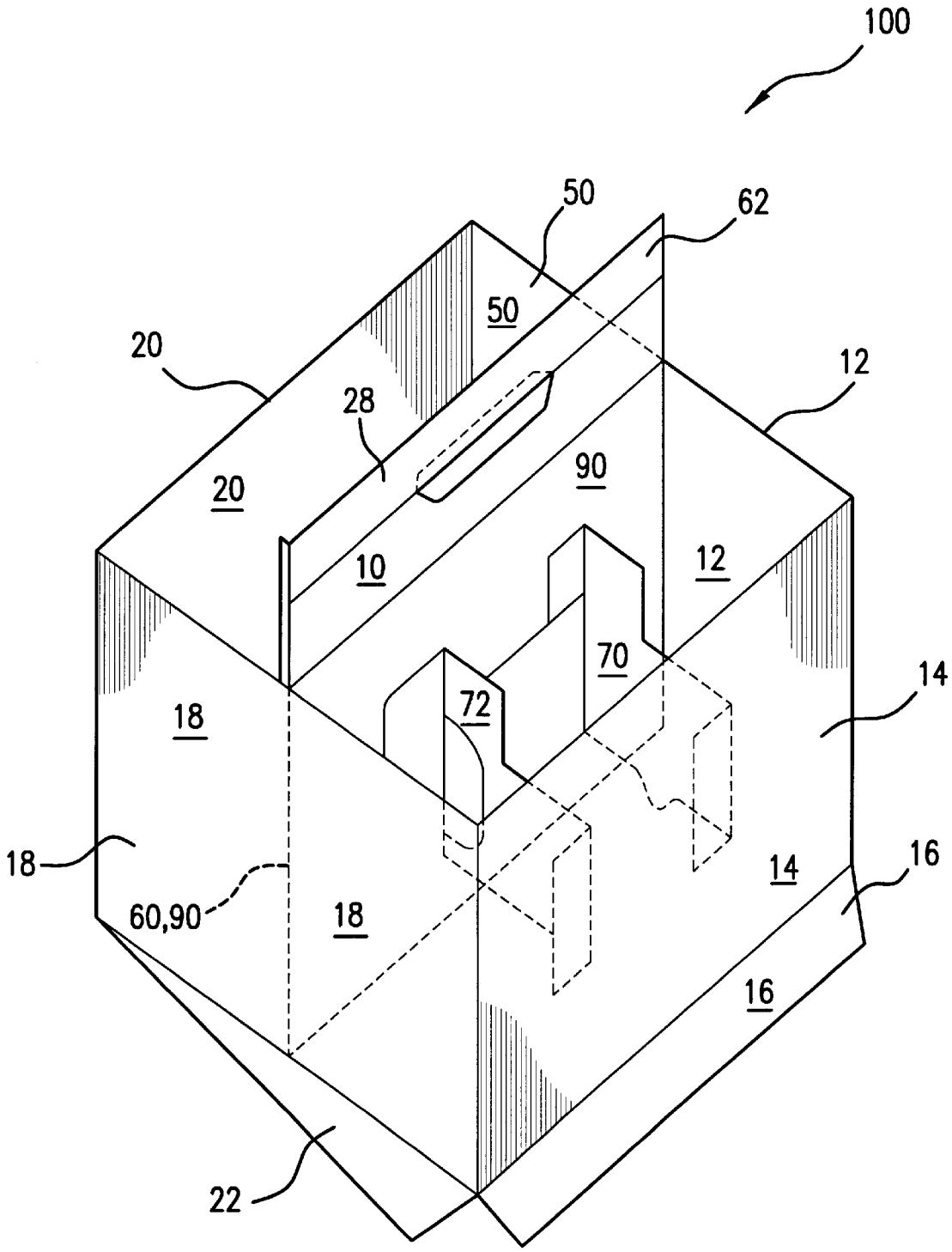
FIG. 2 is a perspective view of a bottle carrier according to the present invention, formed from the blank of FIG. 1.

FIG. 1 is an elevational view of a partition assembly blank 1 used to form a carrier 100 shown in FIG. 2. This embodiment is referred to herein as a four-fold embodiment. The partition assembly blank 1 includes holes 11, 54, and 68 used to form the handle portion (which includes handle components 10, 28, 62) when the partition assembly blank 1 is folded. The partition assembly blank 1 includes a front portion 14, a flap 16, a side panel 18, a rear portion 20, and a bottom flap portion 22.

The portion 10 is joined to the panels 12 and 14 by an easily-broken tear line having soft nick release portions 7, 8, and 9 as shown in FIG. 1. The panel 12 is joined to the panel 14 along a fold line 15, and the panel 16 is joined to the panel 14 by a fold line 6. The panel 14 is joined to the panel 18 along a fold line 17, and the panel 18 is joined to the panel 20 by a fold line 24.

Also as shown in FIG. 1, the panel 18 is joined to a panel 39 along a fold line 19 which includes an easily-broken tear line having soft nick release portions 45, 46, and 47. The panel 39 is joined to a panel 26 by a fold line 27, and is joined to a panel 30 by a fold line 31. The panel 26 is separated from the panel 18 along the cut line 34, so that panels 26 and 18 are separate. The panel 30 is separated from the panels 20 and 50 along the cut line 33, so that panel 30 is completely separate from the panels 20 and 50.

The panel 39 includes the aperture 54, which forms part of the handle portion. The panel 39 is joined by a fold line 5 to panel 28. The panel 28 includes a foldable portion 29 with separated side edge portions (unnumbered) to make it easier to fold. The panel 20 is joined to a panel 22 along a fold line 25, and the panel 22 has an extension 23. The panel 20 is joined to the panel 50 along a fold line 51, and the panel 50 is joined to the panel 60 by a fold line 52. The panel 60 is joined to a panel 90 along a fold line 88, and the panel 60 includes an upper portion having a handle aperture 68 therein.

The panel 60 includes a pair of partition members 70 and 72, which are connected to the panel 60 by respective fold lines 61 and 64. The partition members 70 and 72 have edges, which are respectively severed from the panel 60 along respective score lines 62 and 69. The partition member 70 has a right end portion foldable along fold lines 64, 64, and a flap portion separated by a score line 63. Similarly, the partition member 72 has a right end portion foldable along fold lines 73, 73 and a flap portion separated by a score line 74.

The panel 90 includes a pair of partition members 80 and 82, which are connected to the panel 90 by respective fold lines 91 and 101. The partition members 80 and 82 have edges, which are respectively severed from the panel 90 along respective score lines 92 and 81. The partition member 80 has a left end portion foldable along fold lines 101, 101, and a flap portion separated by a score line 102. Similarly, the partition member 82 has a left end portion foldable along fold lines 86, 86 and a flap portion separated by a score line 85.

The panel 90 is connected to portion 95 by fold lines 96, 96, and is separated from the portion 95 by a score line 93. The panel 90 has a lowermost portion 97, which is an extension formed to provide an additional glue or adhesive area below the handles.

In use, the blank 1 is folded as follows. Fold line 88 is the first fold, fold line 31 is the second fold, fold line 27 is the third fold, fold line 51 is the fourth fold, fold line 17 is the fifth fold, and fold line 5 is the sixth fold. The remaining folds, and glue/adhesive areas, will be readily understood by any one having skill in the art of foldable blanks for beverages.

FIG. 2 is a perspective view of a bottle carrier 100 according to the present invention. In this view, a top portion includes a handle (components 10, 28, 62), and a bottom flap portion 22 which is secured by adhesive to a flap 16 at a manufacturing location. The bottle carrier 100 has a front portion 14, rear portion 20, a side panel 18 connecting the front and rear portions 14 and 20.

The combination carrier and handle apparatus 100 for accommodating a plurality of articles (not shown), are arranged in a pair off substantially parallel co-extensive rows. A single partition blank 1 is made from paper board preferably having at least one white printable side. Said single partition blank 1 includes a first partial side portion 12 joined to a front portion 14 along a first fold line 15, a foldable flap 16 located beneath the front portion 14. A side panel 18 is joined to the front portion 18 along a second fold line 17. A rear portion 20 is joined to the side panel 19 along a third fold line 24. A foldable bottom flap 22 is located beneath the rear portion 20. A second partial side portion 50 is joined to the rear portion 20 along a fourth, fold line 51. A first center panel 60 is joined to the second partial side portion 50 along a fifth fold line 52, and a second center panel 97 is joined beneath the first center panel 60 along a sixth fold line 88.

A first handle portion 10 is joined above the first partial side portion 12 and the front portion 14 with a easily-broken score line 7, 8, 9. A second handle portion 39 is joined above the side panel 18 and the rear portion 20 with an easily broken score line 45, 46, 47.

A third handle portion 68 extends above the center panel 60. The first handle portion 10, the second handle portion 39 and the third handle portion 68 each include a respective handle aperture 11 54, 68 sized and positioned to form an aligned handle portion there-through.

The first and second partition members 70, 72 are foldably connected to the first center panel 60. The first and second partition members 70, 72 each have edges which are severed along respective score lines 62, 69. A first and second flap portion are separated by a respective score line, as shown in FIG. 1 and FIG. 2.

The third and fourth partition members 80, 82 are foldably connected to the second center panel 97. The third and fourth partition members 80, 82 each have edges which are severed along respective score lines 81, 92. A third and fourth flap portion are separated by a respective score line, also shown in FIG. 1 and FIG. 2.

The foldable flap 16 located beneath the front portion 14 is glued to the bottom flap 22 located beneath the rear portion 20. The first, second, and third handle portions are aligned and glued together as best shown in FIG. 2. The first and second flap portions 70, 72 are glued to the rear portion 20 in a manner to form article sized compartments therebetween, and the third and fourth flap portions 80, 82 are glued to the front portion 14 in a manner to form article sized compartments therebetween.

The bottle carrier 100 also includes an opposed pair of sidewalls 12 and 50 which together connect the front and rear portions 14 and 20. A partition member 90 is visible in this view, as are folded connecting extensions 70 and 72 which are respectively adhered to the wall 14. The bottle carrier 100 also includes additional extensions on the opposite side of the partition 90, which are not visible in FIG. 2.

Figure 3:
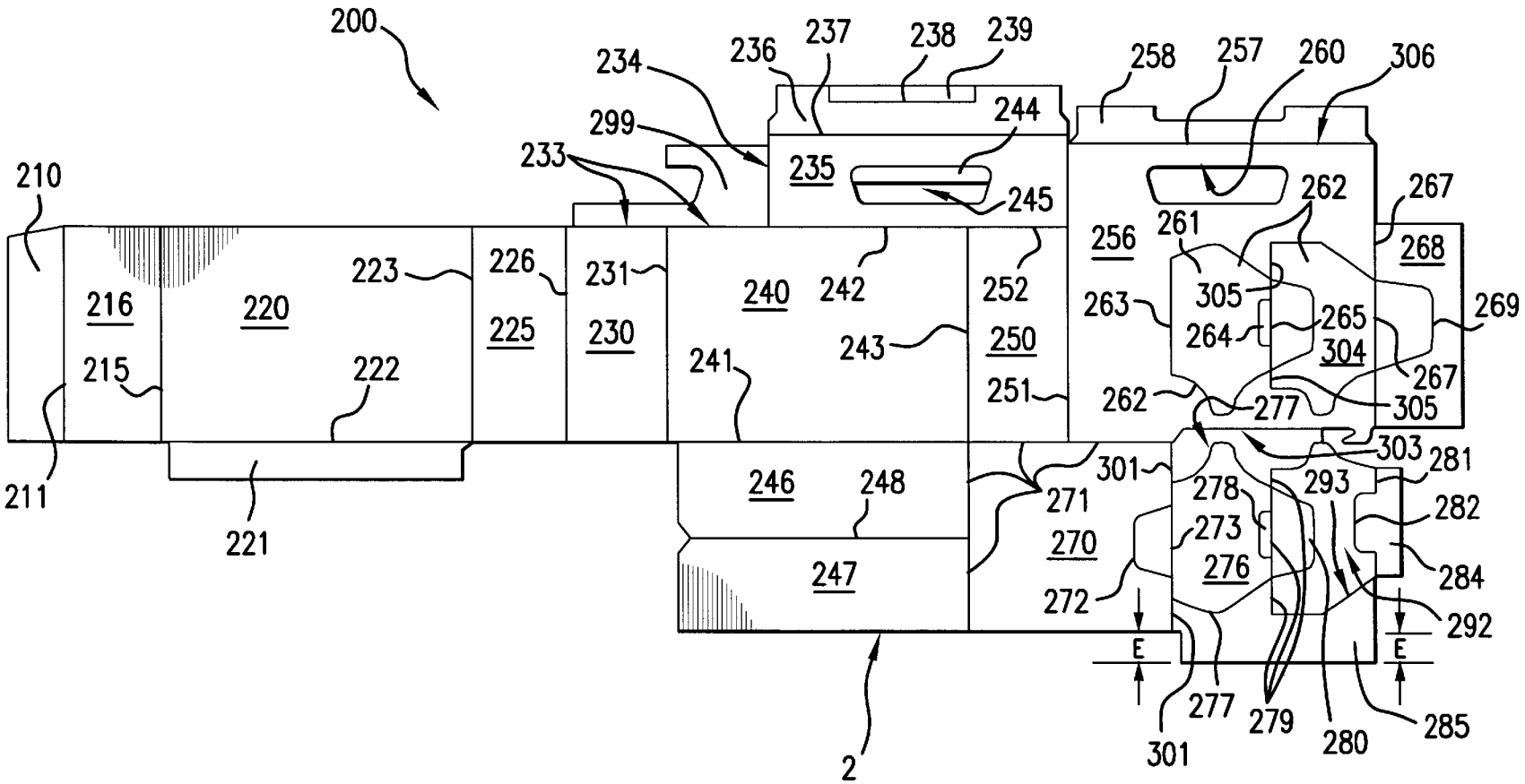
FIG. 3 is an elevational view of a blank used to form a beverage carrier, according to a second embodiment of the present invention.
Figure 4:
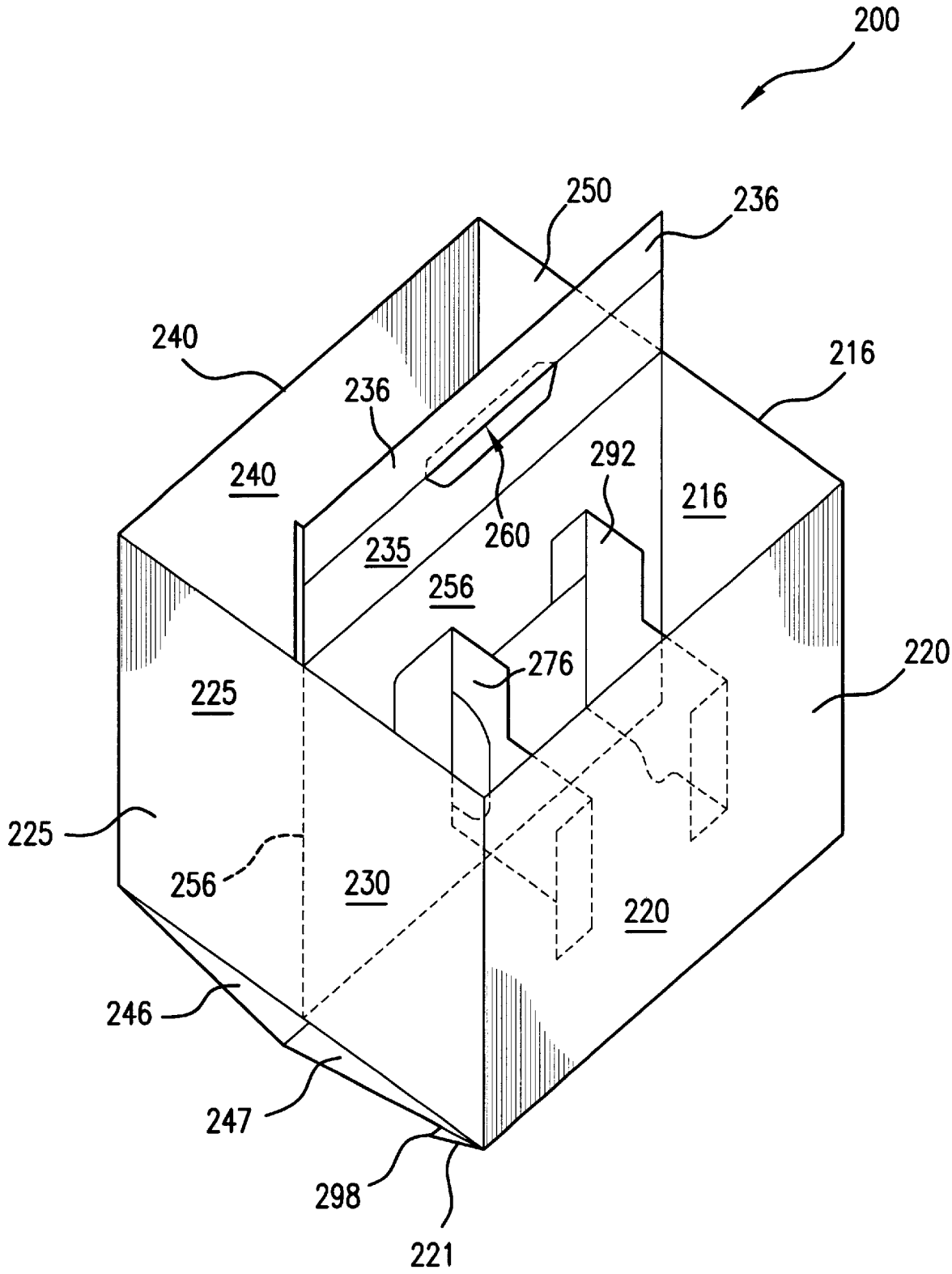
FIG. 4 is a perspective view of a second embodiment of a bottle carrier according to the present invention, formed from the blank of FIG. 3.

FIG. 3 is an elevational view of a partition assembly blank 1 used to form a carrier 200 shown in FIG. 4. This embodiment is referred to herein as a six-fold embodiment. The partition assembly blank 2 includes holes 245 and 260 which are used to form the handle portion (which includes handle components 235, 236, 238, 239, 257, 258, and 299) when the partition assembly blank 2 is folded. The partition assembly blank 2 includes a front portion 220, a flap 221, side panel portions 225 and 230, a rear portion 240, a side panel portion 216, another side panel portion 250, and bottom flap portions 246, 247.

As shown in FIG. 3, a panel 210 is connected to the panel 216 by a fold line 211, and the panel 216 is connected to the panel 220 by a fold line 215. The panel 220 is connected to the flap 221 by a fold line 222, and the panel 220 is connected to the panel 225 by a fold line 223. The panel 225 is connected to a panel 230 by a fold line 226, and the panel 230 is connected to the panel 240 by a fold line 231.

The panel 240 is connected to the handle portion panel 235 by a fold line 242 which is extensively scored and therefore readily frangible, and the panel 240 is connected to the panel 250 by a fold line 243. The panel 240 is connected to the panel 246 by a fold line 241. The panel 246 is connected to the panel 247 by a fold line 248. The handle portion panel 235 is connected to a panel 299 by a fold line 234. The panel 299 is separated from adjacent panels 230 and 240 by a score line 233. The panel 235 is connected to a panel 236 by a fold line 237. The panel 236 has a flap portion 239 foldable along fold line 238 which has severed right and left ends to facilitate folding.

The panel 250 is connected to a panel 270 by a fold line 271, and is connected to a panel 256 by a fold line 251. The panel 270 is connected to the panels 246 and 247 by fold lines 271, 271. The panel 270 is connected to a panel 276 by fold lines 301, 301, the panel 276 having a flap portion bounded by a score line 272 and separated by a fold line 273. The panel 276 is further bounded by a score line 277, 277, and includes a right flap portion 278 separated by a score line 278 and a fold line 279.

The panel 270 and the panel 276 both bound a panel 285 which has a flap portion which extends downwardly a distance E to add handle strength. The panel 276 is connected to a panel 292 by fold lines 279, 279, and is separated therefrom by a score lines 277, 277. The panel 292 is separated by score lines 293, 293. The panel 292 also includes a right flap portion 284 connected to the panel 292 by fold lines 281, 281 and separated from the panel 292 by a score line 282.

The panel 276 is connected to the panel 256 by a fold line 303. The panel 256 has an aperture 260 and is connected to the panel 258 by a fold line 257. The panel 256 is connected to a panel 268 by fold lines 267, 267. The panel 256 is connected to a partition portion 261 along a fold line 263, and is separated therefrom by a score line 262. The partition panel 261 has a flap portion 264 connected along a fold line 265. The panel 256 is also connected to a partition portion 304 by fold lines 305, 305, and is separated therefrom by a score line 269.

In use, the blank 2 is folded as follows. Fold line 301 is the first fold (and is folded up), fold line 303 is the second fold, fold lie 234 is the third fold, fold line 251 is the fourth fold, fold line 267 is the fifth fold (a reverse partial fold), fold line 231 is the sixth fold, and fold line 226 is the seventh fold. The fold line 267, releasing the partial fold of the fifth fold, is considered as the eight fold. The fold line 211 is the ninth fold, and the fold line 223 is the tenth fold. The fold line 306 is the eleventh fold (and is a double fold). The fold line 248 is the twelfth fold. The remaining folds, and glue/adhesive areas, will be readily understood by any one having skill in the art of foldable blanks for beverages.

FIG. 4 is a perspective view of a second embodiment of a bottle carrier 200 and is formed from the blank 2 of FIG. 3. The handle portion 235, 236, 260 includes handle components 235, 236, 238, 239, 257, 258, and 299 when the partition assembly blank 2 is folded. The carrier 200 includes a front portion 220, a flap 221, side panel portions 225 and 230, a rear portion 240, a side panel portion 216, another side panel portion 250, and bottom flap portions 246, 247. The flap 221 is glued or adhered to the bottom flap portion 247, to secure the bottom of the carrier 200.

The carrier 200 includes partition portions 276 and 292. Opposed partition panel portions are also present on the other side of the panel 256, but are not visible in FIG. 4.

The carrier 200 of FIG. 4 can thereby be collapsed by downward extension of the bottom flap portions 246, 247 and folding thereof along fold line 248, the remaining portions of the carrier 200 being, collapsed in a usual manner known to those in the package carrier art.

Figure 5:
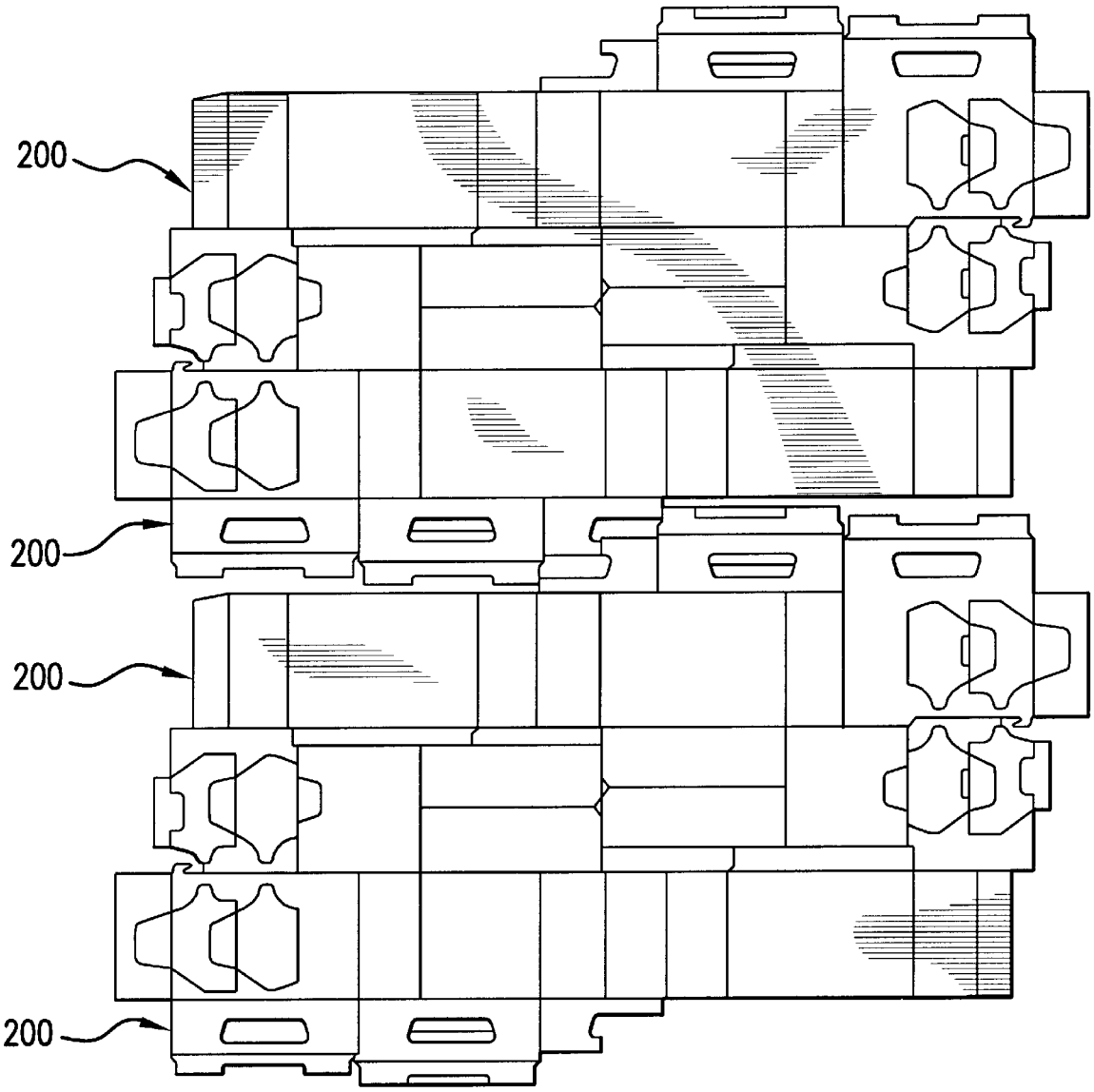
FIG. 5 is a schematic view of a plurality of blanks similar to that of FIG. 3, in a typical manufacturing arrangement.

FIG. 5 is a schematic view of a plurality of blanks 2 similar to that of FIG. 3, in a typical manufacturing arrangement.

Figure 6:
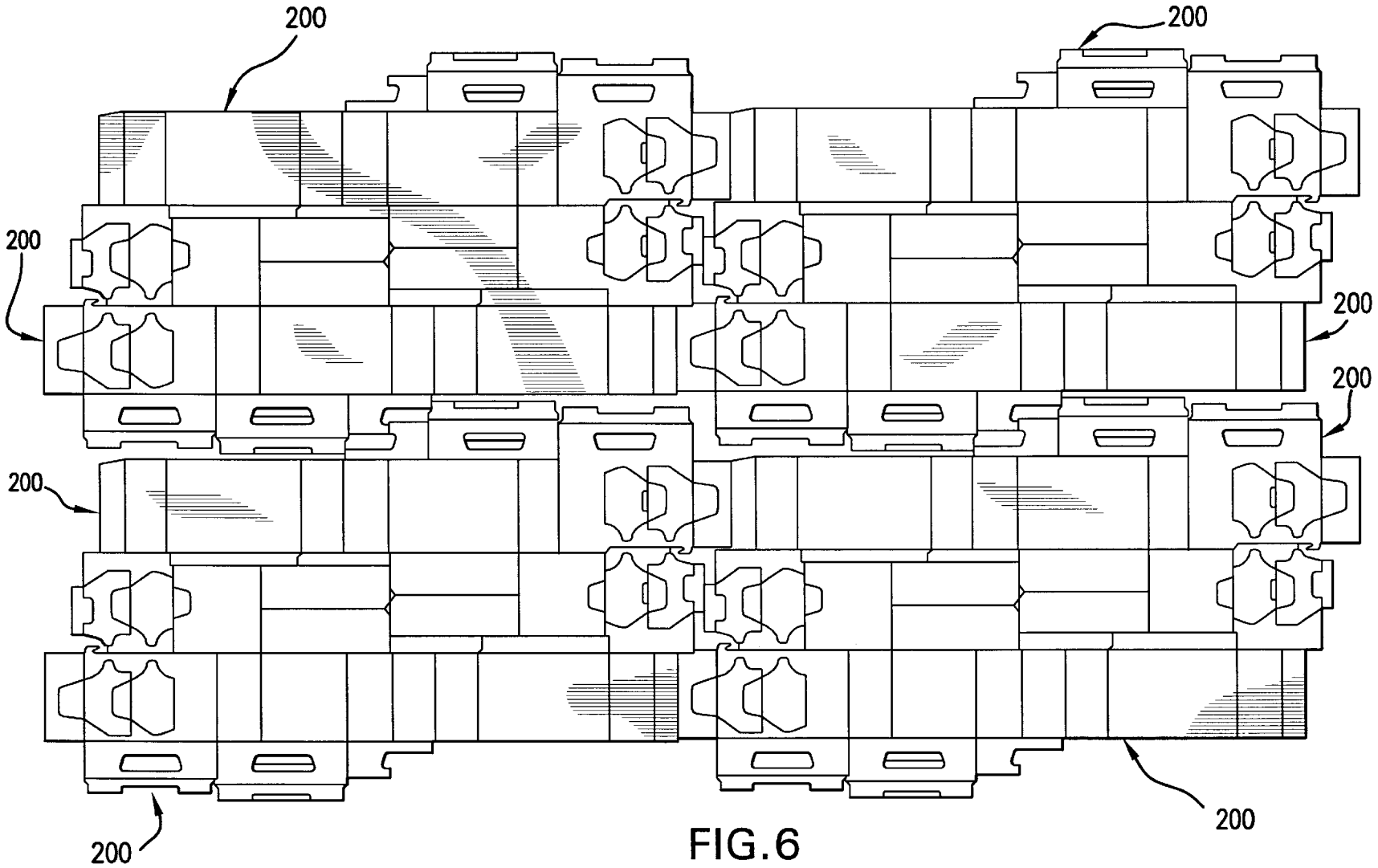
FIG. 6 is a schematic view of a plurality of blanks similar to that of FIG. 5, but with double the number of blanks in adjoining relation, in another typical manufacturing arrangement.

FIG. 6 is a schematic view of a plurality of blanks 2 similar to that of FIG. 5, but with double the number of blanks in adjoining relation, in another typical manufacturing arrangement.

The invention being thus described, it will be evident that the same may be varied in many ways. Such variations are not to be regarded as a departure from the spirit and scope of the invention and all such modifications are intended to be included within the scope of the claims.

I claim:

1. A combination carrier and handle apparatus for accommodating a plurality of articles arranged in a pair of substantially parallel co-extensive rows, which comprises:

a) a single partition blank made from paper board, said single partition blank includes a first partial side portion joined to a front portion along a first fold line, a foldable flap located beneath the front portion, a side panel joined to the front portion along a second fold line, a rear portion joined to the side panel along a third fold line, a foldable bottom flap located beneath the rear portion, a second partial side portion joined to the rear portion along a fourth fold line, a first center panel joined to the second partial side portion along a fifth fold line, and a second center panel joined to the first center panel along a sixth fold line;

b) a first handle portion joined above the first partial side portion and the front portion with a easily-broken score line;

c) a second handle portion joined above the side panel and the rear portion with an easily broken score line;

d) a third handle portion extends above the center panel; the first handle portion, the second handle portion and the third handle portion each include a handle aperture sized and positioned to form a handle portion therethrough;

e) first and second partition members foldably connected to the first center panel, said first and second partition members with edges which are severed along respective score lines, and a first and second flap portion separated by a respective score line;

f) third and fourth partition members foldably connected to the second center panel, said third and fourth partition members with edges which are severed along respective score lines, and a third and fourth flap portion separated by a respective score line; and g) the foldable flap located beneath the front portion is glued to the bottom flap located beneath the rear portion; the first, second and third handle portions are aligned and glued together; and the first and second flap portions are glued to the rear portion in a manner to form article sized compartments therebetween, and the third and fourth flap portions are glued to the front portion in a manner to form article sized compartments therebetween.

2. The apparatus of claim 1, wherein the single partition blank comprises at least one side with a white printing surface.

3. The apparatus of claim 2, wherein indicia is printed upon the white printing surface prior to assembly.

4. The apparatus of claim 1, wherein the score line comprises soft nick release portions to aid in severing the respective portions of the single partition blank.

5. The apparatus of claim 1, wherein the second handle portion includes a first handle extension foldably connected to a first side of the second handle portion, and a second handle extension foldably connected to a second side of the second handle portion.

6. The apparatus of claim 1, wherein an upper flap is foldably connected above the second handle portion.

7. The apparatus of claim 1, wherein the second center panel is folded 180 degrees about the sixth fold line to align with the first center panel; the rear portion is folded up 90 degrees about the fourth fold line; the front portion is folded 90 up degrees about the second fold line; the first partial side portion is folded up 90 degrees about the first fold line; the second partial side portion is folded up 90 degrees about the fifth fold line; and the foldable flap and foldable bottom flap are folded together prior to gluing.

8. The apparatus of claim 7, wherein the single partition blank is stored and shipped in a flat condition, and folded and glued at assembly.

9. The apparatus of claim 8, wherein the foldable bottom flap located beneath the rear portion is foldable about a central portion, the foldable bottom flap is glued to the foldable flap located beneath the front portion, and the central portion of the foldable bottom flap is folded 180 degrees, enabling the apparatus to be pre-glued and shipped flat prior to assembly.

10. A combination carrier and handle apparatus for accommodating a plurality of articles arranged in a pair of substantially parallel co-extensive rows, which comprises:

a) a single partition blank made from paper board having at least one white printing surface, said single partition blank includes a first partial side portion joined to a front portion along a first fold line, a foldable flap located beneath the front portion, a side panel joined to the front portion along a second fold line, a rear portion joined to the side panel along a third fold line, a foldable bottom flap located beneath the rear portion, a second partial side portion joined to the rear portion along a fourth fold line, a first center panel joined to the second partial side portion along a fifth fold line, and a second center panel joined to the first center panel along a sixth fold line;

b) a first handle portion joined above the first partial side portion and the front portion with a easily-broken score line;

c) a second handle portion joined above the side panel and the rear portion with an easily broken score line, the second handle portion includes a first handle extension foldably connected to a first side of the second handle portion, and a second handle extension foldably connected to a second side of the second handle portion;

d) a third handle portion extends above the center panel; the first handle portion, the second handle portion and the third handle portion each include a handle aperture sized and positioned to form a handle portion therethrough;

e) first and second partition members foldably connected to the first center panel, said first and second partition members with edges which are severed along respective score lines, and a first and second flap portion separated by a respective score line;

f) third and fourth partition members foldably connected to the second center panel, said third and fourth partition members with edges which are severed along respective score lines, and a third and fourth flap portion separated by a respective score line; and g) the foldable flap located beneath the front portion is glued to the bottom flap located beneath the rear portion; the first, second and third handle portions are aligned and glued together; and the first and second flap portions are glued to the rear portion in a manner to form article sized compartments therebetween, and the third and fourth flap portions are glued to the front portion in a manner to form article sized compartments therebetween.

11. The apparatus of claim 10, wherein indicia is printed upon the white printing surface prior to assembly.

12. The apparatus of claim 10, wherein the score line comprises soft nick release portions to aid in severing the respective portions of the single partition blank.

13. The apparatus of claim 10, wherein an upper flap is foldably connected above the second handle portion.

14. The apparatus of claim 10, wherein the second center panel is folded 180 degrees about the sixth fold line to align with the first center panel; the rear portion is folded up 90 degrees about the fourth fold line; the front portion is folded 90 up degrees about the second fold line; the first partial side portion is folded up 90 degrees about the first fold line; the second partial side portion is folded up 90 degrees about the fifth fold line; and the foldable flap and foldable bottom flap are folded together prior to gluing.

15. The apparatus of claim 10, wherein the single partition blank is stored and shipped in a flat condition, and folded and glued at assembly.

16. The apparatus of claim 10, wherein the foldable bottom flap located beneath the rear portion is foldable about a central centerline portion, the foldable bottom flap is glued to the foldable flap located beneath the front portion, and the central centerline portion of the foldable bottom flap is folded 180 degrees, enabling the apparatus to be pre-glued and shipped flat prior to assembly.

17. A combination carrier and handle apparatus for accommodating a plurality of articles arranged in a pair of substantially parallel co-extensive rows, which comprises:

a) a single partition blank made from paper board having at least one white printing surface, said single partition blank includes a first partial side portion joined to a front portion along a first fold line, a foldable flap located beneath the front portion, a side panel joined to the front portion along a second fold line, a rear portion joined to the side panel along a third fold line, a foldable bottom flap located beneath the rear portion, a second partial side portion joined to the rear portion along a fourth fold line, a first center panel joined to the second partial side portion along a fifth fold line, and a second center panel joined to the first center panel along a sixth fold line;

b) a first handle portion joined above the first partial side portion and the front portion with a easily-broken score line;

c) a second handle portion joined above the side panel and the rear portion with an easily broken score line, the second handle portion includes a first handle extension foldably connected to a first side of the second handle portion, a second handle extension foldably connected to a second side of the second handle portion, and an upper flap foldably connected above the second handle portion;

d) a third handle portion extends above the center panel; the first handle portion, the second handle portion and the third handle portion each include a handle aperture sized and positioned to form a handle portion therethrough;

e) first and second partition members foldably connected to the first center panel, said first and second partition members with edges which are severed along respective score lines, and a first and second flap portion separated by a respective score line;

f) third and fourth partition members foldably connected to the second center panel, said third and fourth partition members with edges which are severed along respective score lines, and a third and fourth flap portion separated by a respective score line; and g) the foldable flap located beneath the front portion is glued to the bottom flap located beneath the rear portion; the first, second and third handle portions are aligned and glued together; and the first and second flap portions are glued to the rear portion in a manner to form article sized compartments therebetween, and the third and fourth flap portions are glued to the front portion in a manner to form article sized compartments therebetween.

18. The apparatus of claim 17, wherein indicia is printed upon the white printing surface prior to assembly.

19. The apparatus of claim 17, wherein the score line comprises soft nick release portions to aid in severing the respective portions of the single partition blank.

20. The apparatus of claim 17, wherein the second center panel is folded 180 degrees about the sixth fold line to align with the first center panel; the rear portion is folded up 90 degrees about the fourth fold line; the front portion is folded 90 up degrees about the second fold line; the first partial side portion is folded up 90 degrees about the first fold line; the second partial side portion is folded up 90 degrees about the fifth fold line; and the foldable flap and foldable bottom flap are folded together; and the single partition blank is stored and shipped in a flat condition, and subsequently folded and glued at assembly.

* * * * *